United States Patent [19]

Polarek et al.

[11] 4,134,579

[45] Jan. 16, 1979

[54] CARD INSERTER FOR BINDING MACHINE OR THE LIKE

[75] Inventors: Kenneth J. Polarek, Effingham; John R. Newsome, Shumway, both of Ill.

[73] Assignee: World Color Press, Inc., Effingham, Ill.

[21] Appl. No.: 781,842

[22] Filed: Mar. 28, 1977

[51] Int. Cl.[2] ..... B65H 39/00

[52] U.S. Cl. ..... 270/52; 270/57; 271/132

[58] Field of Search ..... 270/52, 54, 55, 57, 270/58; 271/99, 132

[56] References Cited

U.S. PATENT DOCUMENTS

| | | | |
|---|---|---|---|
| 1,441,278 | 1/1923 | Halvorsen | 270/55 |
| 1,449,697 | 3/1923 | Richards | 270/55 |
| 3,844,551 | 10/1974 | Morrison | 271/132 |
| 3,973,768 | 8/1976 | Shannon | 271/132 |

*Primary Examiner*—Ronald E. Suter
*Assistant Examiner*—A. Heinz
*Attorney, Agent, or Firm*—Leydig, Voit, Osann, Mayer & Holt, Ltd.

[57] ABSTRACT

A card inserter for inserting post cards in a series of bound volumes in motion in a production line which includes a pair of horizontally reciprocated feed plates and associated hoppers arranged on opposite sides of a substantially vertical feed plane. A conveyor is provided in the form of a pair of flat endless belts positioned face to face, the belts being trained about a pair of driven pulleys at the inlet end to define a nip at the feed plane as well as pulleys for maintaining the belts in face to face relation along an angular conveyance path. A V-shaped diverter extends downwardly into the nip. The feed plates are reciprocated inwardly and outwardly in synchronism and have one-way frictional driving connection for simultaneous feeding of the lowermost cards against the diverter and thence into the nip so that the cards are delivered to the volume in register with one another. In the preferred form of the invention the feed plates are provided with vacuum ports to which vacuum is applied during the inward motion, and the feed plates are arcuately surfaced to facilitate separation of the lowermost card, with each feed plate having, in addition, a recessed one-way friction roller. Idler rollers on the inlet pulleys provide auxiliary driving nips enabling a shortened stroke of reciprocation. In one embodiment of the invention provision is made for feeding a third card along the feed plane for sandwiching between the first two cards.

10 Claims, 15 Drawing Figures

35
36
41a
41
2
42a
42
38
37
43a
43
32
31
110a
116
143
140
110
66a
67a
141
142
121
101
101a
102a
102
66
67
134
134a
100a
163
120
100
160
135a
P
162
130
21
150
131
133
161
151
132
171
170
P
190
134
136
152
135
20 TO CONVEYOR
173
175
172
DRIVE
153
23
24
24
2

41
42
43
42a
43a
41a
67
67a
66
66a
121
102
102a
101
101a
163
134a
134
135a
161
22
150
151
20'
192
192a
190
152
191
41a
113a
114a
112a
112a
114a
23
24
41
90
113
91
110
110'
20
20'
116
72
50
84
80
73
60
31

CARD INSERTER FOR BINDING MACHINE OR THE LIKE

It is an object of the present invention to provide a card inserter which is capable of feeding, or "blowing in", different cards, simultaneously and in register with one another, into a bound volume which is in motion in an assembling and binding production line, two cards being preferably fed in register, face to face, but with optional provision for the sandwiching of a third card.

It is a related object to provide a card inserter for insertion of multiple cards into a volume in no more time than it takes to insert a single card and employing a mechanism which is positive and reliable in operation and easily constructed, operated and maintained.

It is another object to provide a card insertion procedure which consists of the insertion of plural cards in face-to-face register, which, because of the increased thickness provides increased wedging and "embossment" effect and hence more secure retention than is achieved using conventional single-card "blow in" techniques.

It is still another object of the invention to provide a card inserter which operates reliably over a wide range of card thickness, all the way from the thickness of a normal sheet of paper to the thickness of heavy cardboard, and which is capable of reliable stripping of the lowermost card even where the stack of cards has sheared edges tending to lock adjacent cards together. Thus it is an object to provide an inserter capable of simultaneous insertion of registered cards in which the individual cards may differ substantially in size, thickness and surfacing.

It is yet another object of the invention to provide an inserter which is highly flexible in operation and which is capable of inserting cards in multiple or cards fed singly by the simple act of silencing the unused feeding mechanism. It is a related object, having to do with flexibility, to provide means for adjusting the angle of the conveyance path so that the cards are ejected at the proper position and angle for reliable insertion and retention in the bound volume.

While the invention has particular utility in the "blowing in" of cards in multiple at high velocity, it is an object to provide a card inserter which is equally capable of applying cards to the volume earlier as it is being assembled and bound, so that the cards are permanently bound in, as required under some conditions by postal regulations.

Other objects and advantages of the invention will become apparent upon reading the attached detailed description and upon reference to the drawings in which:

FIG. 1 is a side elevational view of an inserter constructed in accordance with the invention.

Figures 3, 3A:
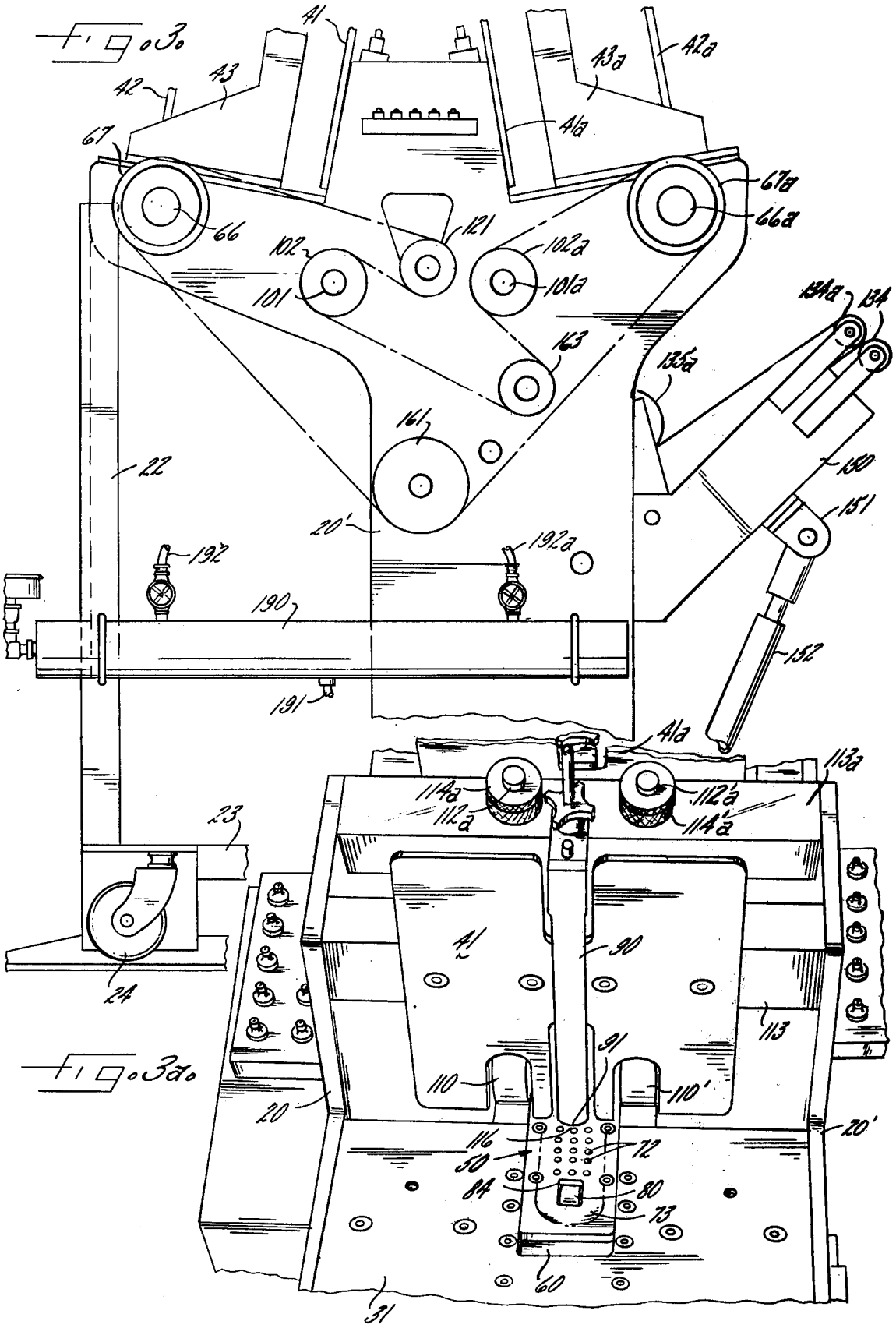
FIG. 3 shows the opposite side of the inserter looking along line 3—3 in FIG. 2.

FIG. 3*a* is a fragmentary perspective of a feed table with the walls of the hopper removed.

Figure 2:
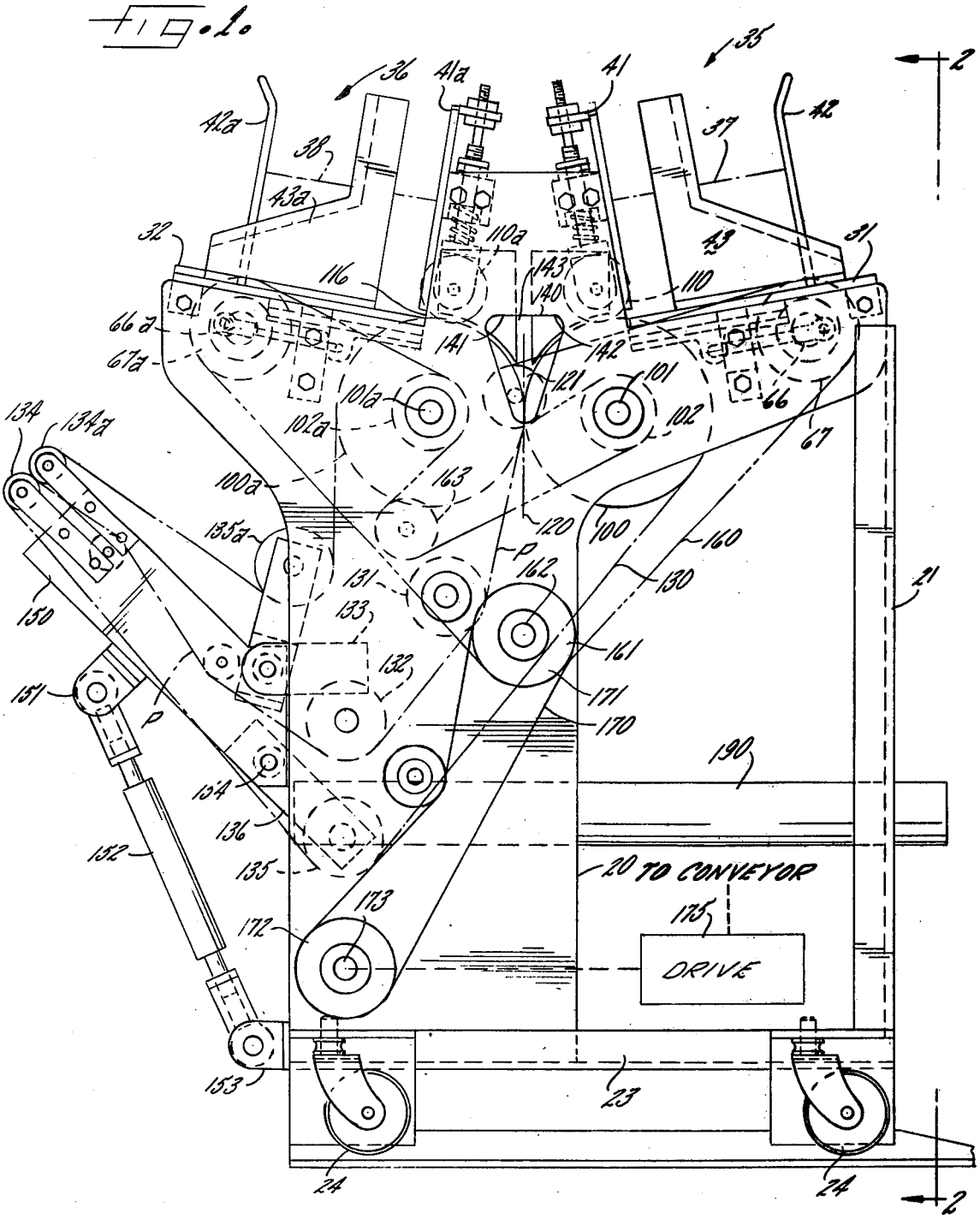
FIG. 2 is an end elevational view looking along the line 2—2 in FIG. 1.
Figure 2:
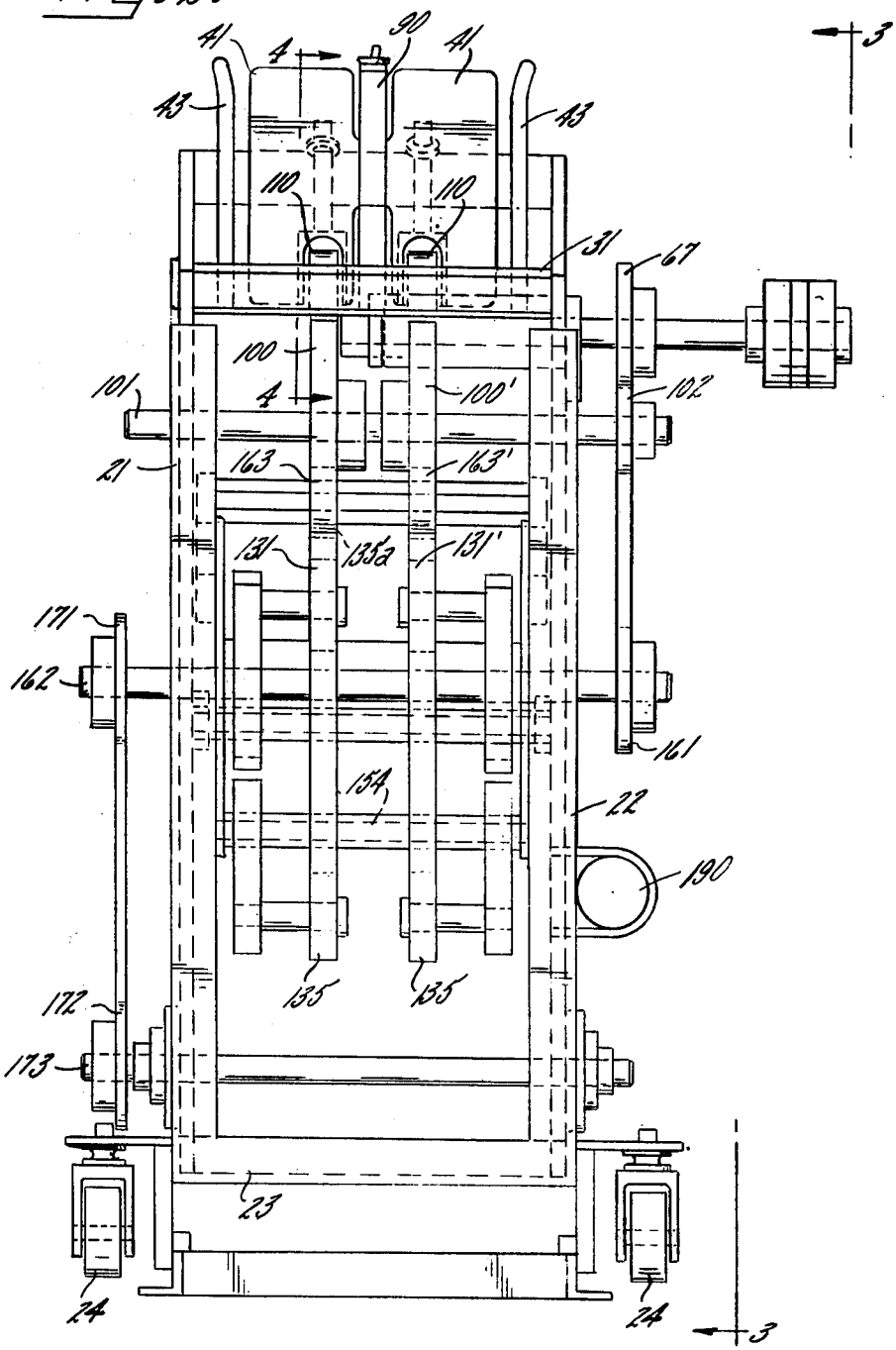
Figure 4:
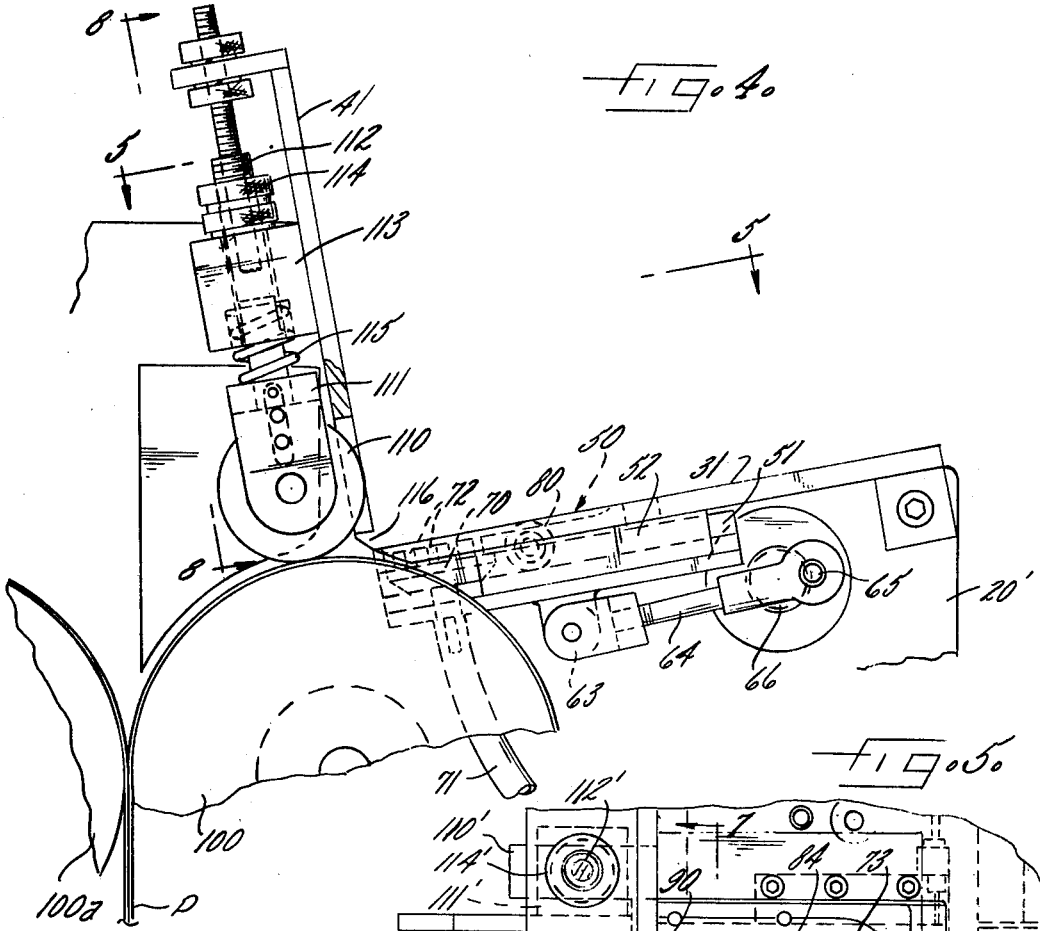

FIG. 4 is an enlarged sectional elevation of the hopper and feed plate assembly looking along line 4—4 in FIG. 2.

Figure 5:
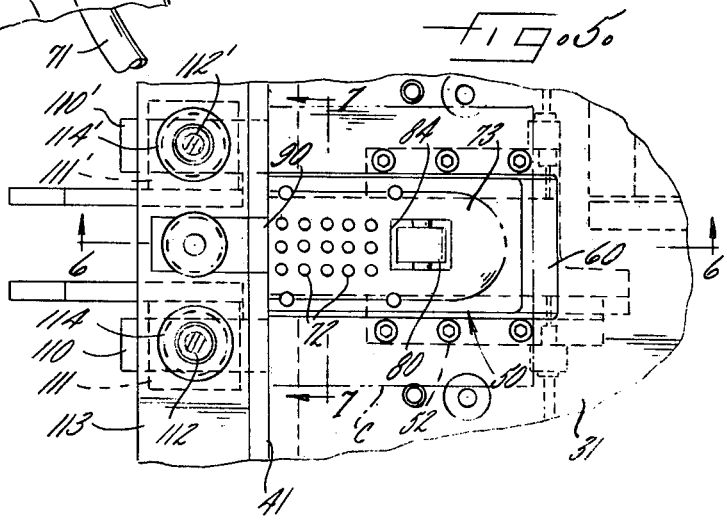

FIG. 5 is a fragmentary top view of the table and feed plate assembly looking along line 5—5 in FIG. 4.

Figure 6:
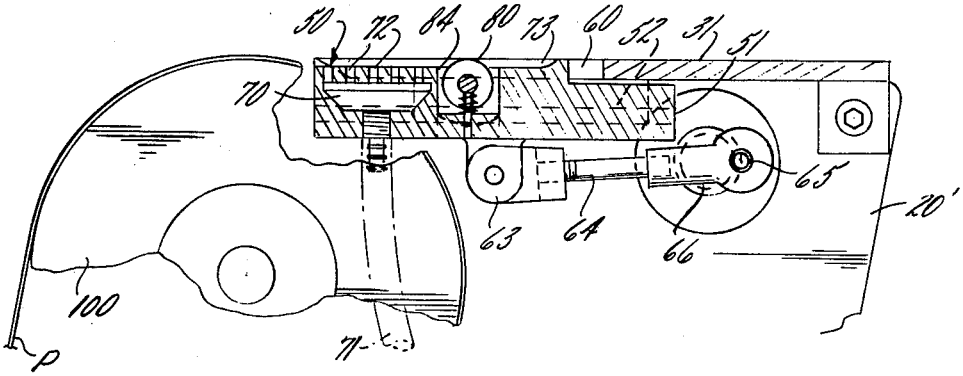

FIG. 6 is a longitudinal cross section showing the feed plate and its reciprocating drive looking along line 606 in FIG. 5.

Figure 6A:
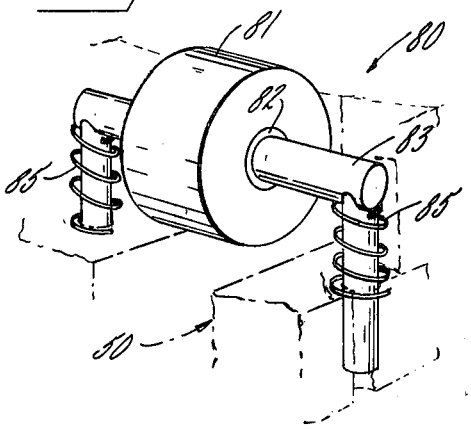

FIG. 6*a* is a fragmentary perspective showing the mounting of the roller recessed in the feed plate.

Figure 7:
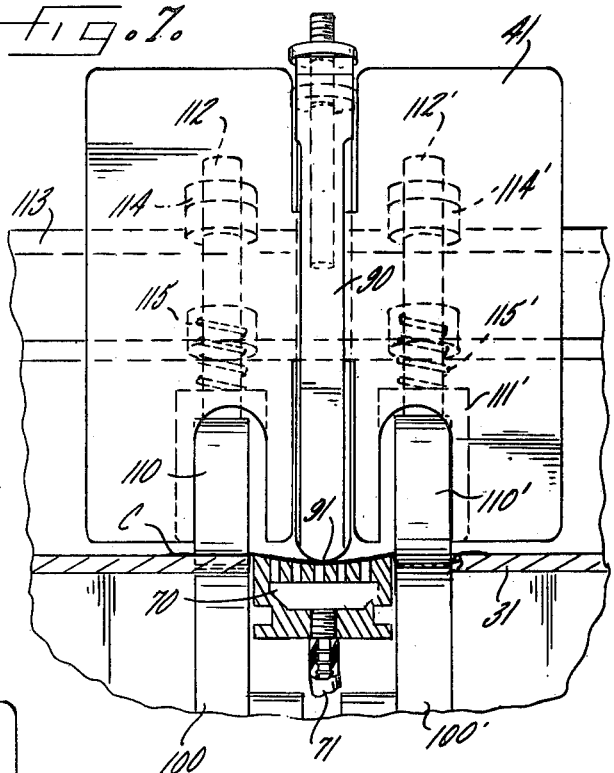

FIG. 7 is a fragmentary transverse section taken through the feed plate and showing the nips for engaging the lateral edges of a card, taken along line 7—7 in FIG. 5.

Figure 8:
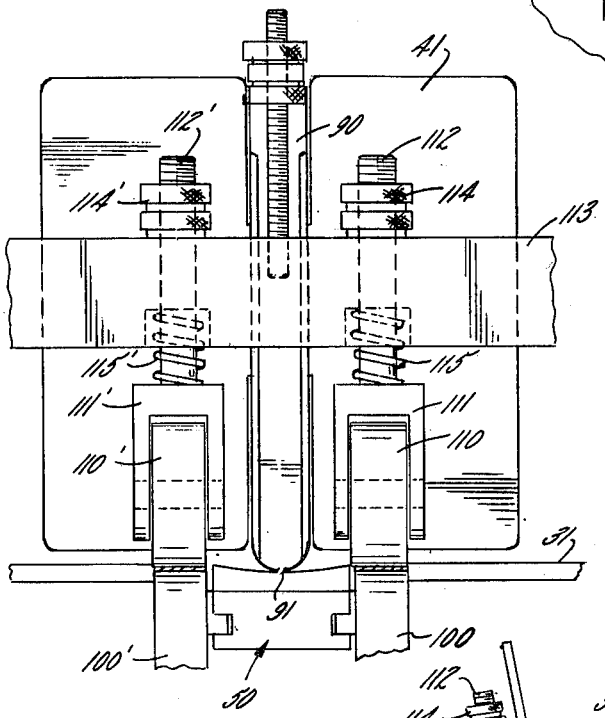

FIG. 8 is a fragmentary elevation looking along line 8—8 in FIG. 4 and showing the stripper bar and adjusting means therefor.

Figure 9:
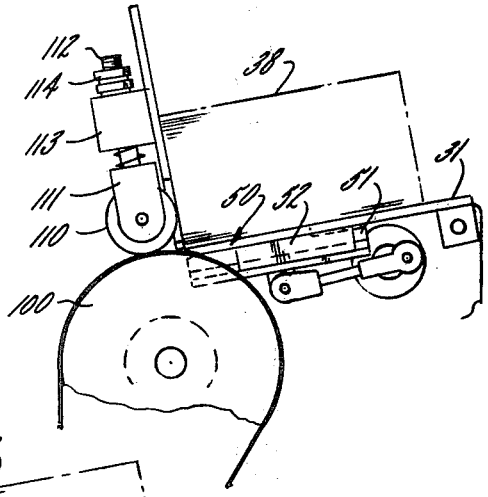

FIG. 9 is a fragmentary stop motion view showing a stack of cards in place in the hopper with the feed plate in reference position at the outer limit of its stroke.

Figure 10:
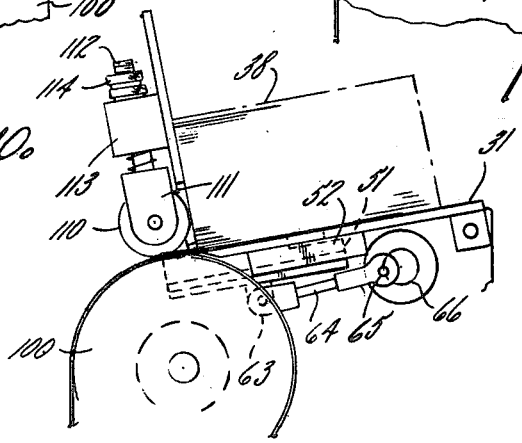

FIG. 10 is a view similar to FIG. 9 showing the feed plate at the inner limit of its stroke and with the edges of the card entered into the driving nip.

Figure 11:
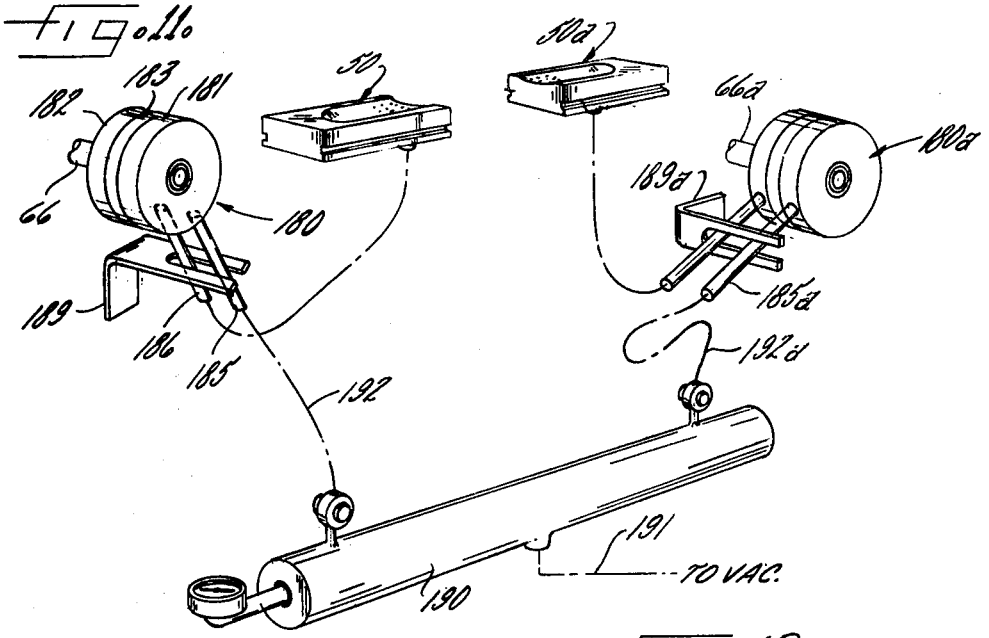

FIG. 11 is a perspective diagram showing the vacuum system.

Figure 12:
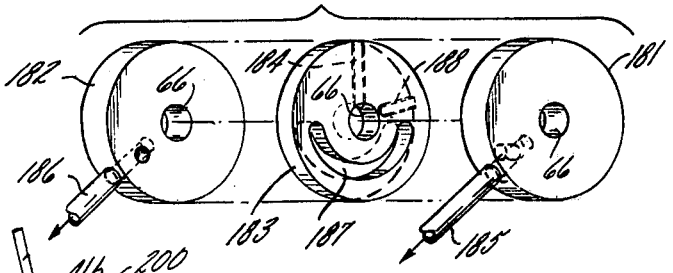

FIG. 12 is an exploded perspective showing the discs which make up a vacuum valve.

While the invention has been described in connection with certain preferred embodiments, it will be understood that we do not intend to be limited to the particular embodiments shown but intend, on the contrary, to cover the various alternative and equivalent constructions included within the spirit and scope of the appended claims.

Turning now to the drawings an inserter constructed in accordance with the present invention is shown, in FIGS. 1, 2 and 3, to include a frame 20 having a pair of frame plates 21, 22 mounted upon a base 23 supported by casters 24. The frame members are generally in the shape of a crossed "T", interconnected at the right and left-hand sides by horizontal table members 31, 32 and cross bars 33, 34. Mounted upon the tables 31, 32 are hoppers 35, 56 enclosing stacks of post cards 37, 38 indicated by the dot-dash lines in FIG. 1.

Taking the hopper 35 by way of example, it has an inner plate 41, outer plate 42 and a pair of side plates 43, the outer plate and side plates being adjustably positionable to the sides of the card and clamped to the table 31 by means of cap screws 45. The hopper 36, similarly, includes an inner plate 41*a*, an outer plate 42*a* and side plates 43*a*, the latter being secured adjustably to the table 32.

For the purpose of feeding cards, one by one, from the bottom of the stack 37 in hopper 35, a feed plate is provided recessed in the table 31 and having friction means thereon for advancing the cards inwardly of the machine. More specifically in accordance with the invention a feed plate is provided at the bottom of hopper 35 mounted for reciprocating movement and with vacuum ports thereon coupled to a source of vacuum, with the vacuum being applied for engaging the lowermost card during inward movement of the feed plate and with the vacuum being turned off during the course of outward movement. In the preferred construction the feed plate in the region of the vacuum ports is channeled out to present a shallow arcuate surface so that, when vacuum is applied. The lowermost card is drawn downwardly from the stack and formed into arcuate cross section, with a stationary stripper at the outlet of the hopper for permitting passage of the lowermost card while holding back the remainder of the stack. Further in accordance with the invention the feed plate is provided with a recessed friction roller which is upwardly biased and which has a one-way clutch so that the roller applies friction to the lowermost card during inward movement but with the roller rotating idly, and frictionlessly, as the feed plate is retracted. Thus, turning now to FIGS. 4-8, there is shown a feed plate 50 made up of a base portion 51 and a top plate 52, the base portion being provided with way surfaces 53, 54. The feed plate is recessed in an opening 60 formed in the table 31 and which is long enough to permit limited reciprocation. For guidance, way surfaces 53, 54 on the feed plate engage cooperating ways 62, 62 in the table structure.

For driving the feed plate 50 back and forth it has, on its underside, a bracket 63 which is interconnected, by means of a connecting rod 64, to a crank 65 mounted upon a shaft 66 having a drive sprocket 67 at one end thereof. For the purpose of applying vacuum to the lowermost card, indicated at C in FIG. 7, the feed plate 50 is of hollow construction to form a vacuum plenum 70 which is coupled to a source of vacuum by means of a line 71. Vacuum is applied to the underside of the card by means of vacuum ports 72. The top surface 73 of the feed plate has a shallow arcuate channel in the region of the vacuum ports. Thus when vacuum is applied, the lowermost card is drawn downwardly away from the stack and into an arcuate profile, which not only facilitates stripping of the lowermost card but also rigidifies the card in a longitudinal direction which is particularly desirable where the card is of light gauge stock.

In addition to the direct friction of the card against the top surface of the feed plate, a friction roller is recessed in an opening in the feed plate, the roller being vertically movable and urged upwardly by a spring, preferably a pair of coil springs. The rubber roller, indicated at 80 is made up of a resilient, highly frictional rubber tire 81 (FIG. 6*a*) mounted upon a one-way clutch 82 which is secured to a stationary cross shaft 83. The shaft 83 is mounted for vertical movement within a clearance opening 84 in the feed plate, being biased upwardly by a pair of light coil springs 85. The one-way clutch 82 is so faced that when the feed plate 50 moves inwardly (to the left as illustrated), the roller 80 is blocked against movement and thus has frictional drag against the lowermost card, whereas when the feed plate moves outwardly, the roller is free to rotate idly so that there is no "return" friction. It is to be noted that the function performed by the vacuum and that performed by the frictional roller are not only additive in effect by synergistic since the vacuum acts to pull the lowermost card down against the roller overcoming the biasing springs 85 and thereby increasing the roller reaction force.

For the purpose of insuring that only the lowermost card in the stack may escape inwardly from the hopper as a result of the reciprocating movement of the feed plate, the front wall of the hopper is centrally relieved to accommodate a stripper bar 90 having a curved and beveled lower edge 91 which conforms to the curvature of the arcuate surface 73 but which is spaced above it by an amount just slightly greater than a single card thickness. The stripper bar 90 is provided at its upper end with an inwardly extending bracket 92. The bracket is held captive between a pair of opposed adjusting nuts 93 which engage a threaded post 94 which is anchored in the cross member 33. To achieve a clearance adjustment, the top nut is loosened, the bottom nut is turned up or down, an appropriate, following which the top nut is retightened to clamp the stripper member 90 in an accurately adjusted position.

In accordance with one of the aspects of the present invention a driving nip is provided immediately inside of the inner plate 41 of the hopper so that the leading edge of the lowermost card is gripped after relatively limited movement of the card from its position in the stack, on the order of an inch or so, thereby to reduce the required length of the reciprocation stroke. This is accomplished by providing a driven pulley at a position inwardly of the hopper and in a position which is substantially tangent to the card which is ejected from the hopper and by providing an idler roller superimposed on the pulley to form a driving nip which engages the card, drawing the card out of the hopper and propelling it into the associated conveyor, to be described. More specifically in accordance with the invention, a pulley is provided which consists of two axially spaced sections which straddle the feed plate and which engage the lateral edges, and only the lateral edges, of the card being acted upon. The sections of the pulley are engaged by corresponding, separate, sections of idler roller to form a pair of nips acting upon the leading corners of the card. It follows from this that the feed plate which propels the cards should, in accordance with the invention, be made substantially narrower than the width of the narrowest card to be handled.

Referring to FIGS. 4 and 7, a pulley consisting of sections 100, 100' is mounted upon the cross shaft 101 which is journaled in the frame and which carries the drive sprocket 102 and at one end which is driven by means to be described. Riding upon the pulley sections 100, 100' are roller sections 110, 110'. Taking the idler roller 110 by way of example, it is mounted in a clevis 111 secured to a plunger 112 which extends through guides 113, 114, with the clevis, and hence the roller, being urged downwardly by a biasing spring 115. The result is to produce a drive nip 116. For minimizing the distance which the card must travel before striking the nip, the inner plate 41 of the hopper is notch-d as indicated at 117 to accommodate the idler roller. Corresponding mounting structure is employed for the roller 110 identified by corresponding reference numerals. In short, by providing a feed plate 50 which is narrower than the transported card so that the edges of the card project at either side, and by providing nip rollers which straddle the feed plate to nip only the lateral edges of the card, the movement into the nip is minimized; in a practical case it may be reduced to even less than an inch, as seen from comparing FIG. 9, in which the feed plate is retracted, to FIG. 10 which shows the limit of inward position and with a full degree of overlap between the feed plate and lower nip roller.

While only the elements associated with the right-hand hopper 35 (FIG. 1) have been described above, it will be understood that similar structure is employed at hopper 36, in mirror image, corresponding parts being given corresponding reference numerals with addition of subscript a. Thus upon rotation of shaft 66*a*, which is driven by sprocket wheel 67*a*, the feed plate associated with the hopper 36 cyclically reciprocates, with timed application of vacuum, to transport the leading edge of a card from the hopper into the nip 116 between rollers 100*a*, 110*a*. The cards fed from the hopper 36, it will be understood, will normally differ from those fed from hopper 35, not only in content but in size, thickness, and type of stock.

In accordance with the present invention the hoppers and their upwardly facing feed plates are arranged symmetrically on opposite sides of a central feed plane, with the cards which are fed mutually inwardly being diverted downwardly in face-to-face register with one another into a conveyor formed of a pair of flat endless belts arranged face to face. The belts are trained about a pair of pulleys at the inlet end to define an inlet nip at the feed plane and a pair of pulleys at the outlet end, as well as intermediate pulleys for maintaining the belts snugly face to face along an angular conveyance path.

Further in accordance with the invention the same pulleys which provide individual nips at the respective hoppers cooperate with one another to provide a conveyor nip.

Thus, referring to FIGS. 1 and 2, the pulleys 100, 100*a*, rotated on shafts 101, 101*a*, having drive sprockets 102, 102*a*, are centered upon a vertical feed plane 120 forming a nip 121 in alignment therewith. A first belt 130, which may be in the form of a flat ribbon of rubberized fabric, is trained about pulley 100, passing downwardly about an idler pulley 131, thence about a swingable idler pulley 132, mounted upon an arm 133, and from which the belt passes upwardly in dog-leg fashion to a pulley 134 at the left-hand, or discharge, end. The belt, having completed its function, returns along a downward path about an idler pulley 135 swingably mounted upon an arm 136, with the belt then proceeding angularly upwardly to engage the right-hand side of the pulley 100.

The left-hand belt, indicated at 130*a*, passes downwardly from the nip 121 and also about idlers 131, 132 to an outlet pulley 134*a* at the discharge end. The return run of the belt is passes about idler pulley 135*a* for return at the left-hand side of pulley 100*a*.

It will be understood that the conveyor just described, and which is illustrated in FIG. 1, comprises one-half of the total conveyor system, namely, that which is associated with the pulley 100 illustrated in FIG. 7. It will be understood that a separate belt trained about separate pulley sections is associated with pulley 100' which is spaced inwardly of the machine, as viewed in FIG. 1, on the opposite side of the feed plates. The separate belt section, and its associated pulleys have, for the sake of simplicity, been given the same reference numerals as just described, with addition to a prime. Since the pulleys 100, 100' are driven in unison by driving means to be described, it will be understood that all four of the conveyor belt sections 130, 130*a* and 130', 130'*a*, are driven at precisely the same speed, so that the cards, which are gripped along their lateral edges, are transported without skew or change of position just as if the belts embraced the cards over their full width.

In accordance with one of the aspects of the invention, a diverter of "V" shape is provided at the feed plane and extending downwardly into the region of the nip 121 so that cards fed from the hoppers 35, 36 and advancing mutually inwardly toward the feed plane 120 strike the diverter and are diverted downwardly, in unison, into the nip 121 where they are simultaneously engaged and transported along the conveyance path P in register with one another, with ejection at the discharge end of the conveyor indicated at 134.

In the present instance the diverter indicated at 140, which is of overall "V" cross section, is formed of portions 141, 142 having a clearance space 143 inbetween centered on the feed plane 120 and for a purpose to be described. While not specifically shown, it will be understood that the diverter 140 extends over the width of both belt sections so that it acts upon the entire width dimension of the diverted card.

It is one of the features of the invention that the conveyance path P is of dog-leg configuration, with the cards first passing doenwardly at an angle with respect to the vertical feed plane, around intermediate pulleys, and then upwardly at an angle to provide a height and direction of discharge which is well suited for either "blow in" or "binding in" purposes. To further add to the flexibility of the discharge, thereby to adapt the machine, on a semiportable basis, to different set-ups, provision is made for changing the angle of the dog-leg. This is accomplished by mounting the discharge pulleys on a vertically swingable arm which is supported in position by a turnbuckle or equivalent length-adjustable link. The arm, indicated at 150, and which is formed, like the belt, of two cooperating sections, the a bracket 151 which is coupled, by a turnbuckle 152 to a stationary bracket 153 mounted on the frame. By rotating the turnbuckle the supporting arm 50 can be caused to rock upwardly and downwardly with respect to its pivot axis indicated at 154. Such adjusting movement does not change the belt tension in view of the use of swingable take-up pulleys which are mounted upon arms which may be suitably biased, by means not shown, in the belt-tensioning direction.

In carrying out the invention, all of the moving elements which have been described including the reciprocating feed plates, belts and pulleys are driven in synchronism from a single driving port, preferably employing sprocket wheels and chains in order to insure that synchronism is maintained for the life of the device. Thus as shown in FIG. 3 a sprocket chain 160 is used which is engaged by a drive sprocket 161 on a cross shaft 162. The chain 160 passes progressively about sprocket 67*a* a-sociated with the hopper 36, sprocket 102*a* on the associated nip pulley, and about an idler 163 which is secured to the frame.

From idler 163 the chain is trained about sprocket 102 associated with nip pulley 100, a second idler 164 mounted on the frame and, finally, about sprocket 67 which serves to drive the feed plate in the hopper 35. The friction of the belts upon the inlet nip pulleys 100, 100*a* is sufficient for driving purposes and all of the other pulleys which engage the belts may, for the sake of simplicity, be in the form of idlers.

For driving the cross shaft 162 a sprocket chain 170 is employed on the opposite side of the machine which is coupled to the cross shaft by means of a sprocket 171 at its upper end and which has, at its lower end, a drive sprocket 172 mounted upon a shaft 173. The shaft 173 is rotated by any suitable driving means which may be coupled, for purposes of synchronization, to the drive of an associated production line. The drive, in any event, has been indicated generally at 175.

In the above discussion it has been assumed that means are provided for applying vacuum to the feed plates synchronously during their inward stroke. Preferably the timing is accomplished by a valve which is directly coupled to the shafts 101, 101*a* which, via a crank connection, reciprocate the feed plates. Thus referring to FIG. 11 there are shown valves 180, 180*a* which are mounted upon the crank drive shafts 101, 101*a*, respectively. Taking the valve 180 as representative, it will be seen, in FIG. 12, that it consists of three superimposed discs, two stationary outer discs 181, 182 and a central rotated disc 183, the latter being secured to the drive shaft by means of a set screw 184. The central disc may be made of steel while the two outer discs may be of plastic.

With regard to the porting, the disc 181 serves as an inlet disc providing an inlet connection 185 while the disc 182 provides an output connection 186. The central, rotatable, disc has an arcuate slot extending through it, indicated at 187, which covers an arc of 180°. Thus the slot provides free communication between the inlet and outlet, for application of vacuum to the connected feed plate, during one-half a revolution, while cutting off the vacuum during the remaining half. The rotating disc 183 is notched as indicated at 188 to provide momentary communication between the outlet line and the atmosphere for venting purposes at the beginning of the "off" portion of the cycle.

In order to maintain the outer discs 181, 182 stationary, even though they are mounted upon a rotating shaft 101, a bracket 189 is provided of forked construction which holds the outlet and inlet connections 185, 186 between the tines. The valve 180*a* which occupies a symmetrical position on the machine is constructed in the same way and similar parts have, where applicable, been indicated by the same reference numeral with the addition of subscript a.

Conveniently, vacuum may be applied from a plenum 190 having an inlet connection 191 and outlet connections 192, 192*a* as shown in FIG. 11.

In operation, then, with the drive 175 connected to the machine, with all of the described parts in operation, and with a supply of cards in the hoppers, the feed plates will move from a reference retract condition illustrated in FIG. 9 mutually inwardly. Vacuum is applied during such inward stroke by the valves 180, 180*a*, causing the cards to be sucked down into the arcuate condition illustrated in FIG. 7, thereby causing each card to adhere to the upper surface of its feed plate. Auxiliary friction is provided by means of the associated upwardly-biased rubber roller 80 which is stationary during the forward stroke and against which the card is drawn by the effect of vacuum. Thus cards advance mutually inwardly tangent to the nip pulleys 100, 100*a* and into the nips defined by the superimposed idler rollers 110, 110*a*. The advancing cards are, toward the end of the forward stroke of the feed plate, gripped along their lateral edges, starting at the lead corners, with the cards being drawn clear of the feed plates as the vacuum is released.

Both of the cards, approaching from opposite directions, are propelled by their respective nips into engagement with the V-shaped diverter 140 which guides the cards in registering face-to-face relation into the nip 121 of the conveyor where the cards become captive between the belts 160, 160*a* passing through the dog-leg conveyance path for exit between the discharge pulleys 134, 134*a* at the left-hand side of the machine. The cards exit at a velocity which is preferably between 5 and 7 feet per second which is adequate to accomplish what is generally referred to as "blow in". Ejection of the cards into the volume is preferably done "on the fly", that is, with the volume moving at conveyor speed in the assembly and binding machine. To facilitate insertion of the cards it will be understood that in a conventional production line moving volumes are commonly separated by a parting element, or plow, just prior to reaching the point of card insertion. The cards, which are discharged in face-to-face register, are ejected into the volume with sufficient force and velocity so that they will wedge themselves adjacent the binding, where they will stay, in spite of subsequent shipment and handling, until intentionally removed. It is found, as one of the features of the present invention, that two cards, face to face, will be retained in the volume more securely than where a single card is blown in as in conventional practice. Not only does the additional thickness provide improved wedging effect but there is, in addition, a more positive embossment of the card into the adjacent pages. Such embossment comes about by the fact that the volume, when complete and ready for shipment, is usually stacked and bound together with similar volumes tending to compress the pages tightly together.

However, the present machine is not limited to insertion of cards by "blow in" but is equally applicable to feeding of cards incident to assembly of the signatures at a binding station, and prior to the actual binding, so that the cards are positively bound in place. In both modes of operation the dual cards are, in effect, inserted as a single card and so single card insertion techniques, well known in the art, are fully applicable in coupling the present machine to a production line.

Figure 13:
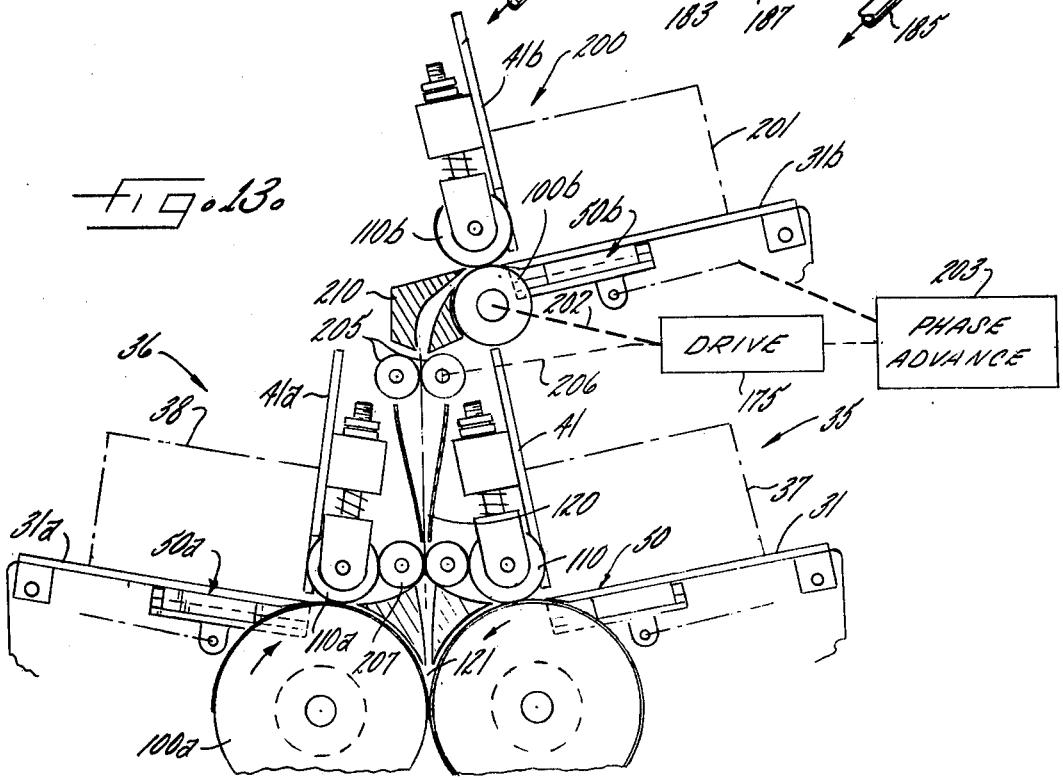

It is one of the features of the present invention that three cards instead of two may be inserted simultaneously by the "piggybacking" of a third hopper 200 having a stack of cards 201 above the two hoppers 35, 36 as illustrated in FIG. 13, with the card from the hopper 201 being fed vertically downward along the feed plane 120, and with the feed being initiated sufficiently in advance so that all three of the cards arrive simultaneously at the nip 121.

Thus, referring to FIG. 13, it will be seen that the hopper 200 and its associated parts correspond to the hopper 35 so that the same reference numerals have been employed with addition of subscript b. The initial nip roller 100*b* has a suitable connection 202 to the drive 175 to produce a peripheral, or card, velocity which is the same as the velocity of the main conveyor. Feeding movement of the feed plate 50*b* is slightly advanced in phase, to achieve simultaneous arrival at the conveyor nip 121, by any suitable phase advancing device 203 interposed in a drive line 204. To bridge the gap between the nip roller 100*b* and the main nip 121, additional pairs of resiliently surfaced drive rollers may be used as, for example, rollers 205 connected to the drive by a suitable connection 206 and rollers 207 which may have a similar drive connection or which may be rotated by respective contact with nip idler rollers 110, 110*a* as shown. A diverter 210 serves to turn the card approximately 90° and into the feed plane 120.

It is one of the features of the aspect of the invention illustrated in FIG. 13 that the central clearance space 143 (see also FIG. 1) which is provided along the feed plane 120 and between the two portions of the V-shaped diverter 140 provides for the simultaneous entry of three cards into the nip 121.

While it will seldom be necessary to inject more than three cards into a volume at the same time, it will be apparent to one skilled in the art, with the above teachings in mind, that the present invention is readily extendable to the handling of four cards. This can be done by providing a further hopper assembly at the level of the hopper assembly 200, and which is a mirror image thereof, and by employing a symmetrical, V-shaped diverter in place of the single diverter 210 so that two cards are fed simultaneously into the nip of drive rollers 205.

At the other extreme, it is one of the features of the present construction that it may be employed for inserting but a single card simply by silencing one of the hopper assemblies and without any other change being required. This can be done, for example, by removing one of the stacks of cards 37, 38 (FIG. 1) and by turning off the corresponding vacuum line. Valves V may be used for selective turn-off as illustrated in FIG. 11. To silence both sides a mechanical throw-off clutch (not shown) is provided in the drive train.

Using the above described machine, post cards may be inserted in a magazine or other volume just as quickly and efficiently as a single card. Since the printer is usually compensated on a "per card" basis, the profit on each insertion step is proportionately multiplied. At the same time retention, due to increased wedging and embossment effects, is greatly improved.

While mention is made herein of insertion of cards in a series of "bound" volumes, it will be understood that the present machine is usable in two separate modes, as described, and that the term "bound" therefore should be considered to include finished volumes as well as volumes in the process of assembly and binding. Regardless of whether the cards are inserted in a previously bound volume, or a volume as it is being bound, the present inserting machine, it will be understood, is synchronized with the binding machine by direct interconnection of the mechanical drives of the two machines. Accurate synchronization is preserved within the inserter by using either a sprocket chain or a double faced timing belt or, if desired, meshed gears directly interposed between the rotating shafts.

The term "arcuate" as applied to the evacuated surface 73 refers primarily to a curved surface, preferably concave, but which might conceivably be convex, and regardless of whether the surface is smoothly curved or made up of shallow steps. Using vacuum to separate a card from a stack and for creating sufficient normal force to develop friction for feeding purposes has the further advantage that the results are uniform and consistent regardless of the number of cards stacked in the hopper. In devices of more conventional design, conditions are adjusted for a stack of average size and, unless a hold-down weight is employed or other means are provided for biasing the stack downwardly the feeding becomes inconsistent as the stack is depleted. In contrast, the present machine does not require any weight or the like for applying pressure to the stack and yet it is capable of feeding reliably and positively down to the very last card.

What is claimed is:

1. A card inserter for inserting post cards in a series of volumes in motion in a production line comprising, in combination, a frame, an upwardly-facing feed plate mounted for reciprocation on the frame, means for driving the feed plate in feeding and retracting directions, a hopper stationarily mounted on the frame for holding a stack of cards superimposed on the feed plate, a friction roller recessed in the feed plate and having a one-way clutch connection, the feed plate having vacuum ports coupled to a source of vacuum, valve means interposed between the vacuum ports and the source of vacuum for applying vacuum to the lowermost card of the stack for transport of the card from the hopper during the feeding movement of the feed plate and for releasing vacuum during the retracting movement thereof, the feed plate having a shallow channel of concave profile formed therein in the region of the vacuum ports so that the lowermost card, upon application of vacuum, is drawn downwardly into concave shape away from the bottom of the stack and toward the friction roller, the hopper having a stationary stripper bar adjacent the path of feeding movement of the lowermost card for permitting such card to pass while preventing passage of the second and succeeding cards in the stack, and a driven conveyor including an inlet nip for engaging the transported card and for conveying it positively at high speed to the point of insertion.

2. A card inserter for inserting post cards in a series of volumes in motion in a production line comprising, in combination, a frame having a substantially vertical feed plane and a pair of upwardly facing feed plates on opposite sides thereof, a pair of hoppers on the frame for holding respective stacks of cards supported on the feed plates and having respective outlets, a conveyor in the form of a pair of flat endless belts arranged face-to-face having an inlet end and an outlet end and positioned along an angular conveyance path, the belts being trained about a pair of pulleys at the inlet end to define an inlet nip at the feed plane and a pair of pulleys at the outlet end as well as intermediate pulleys for maintaining the belts snugly face-to-face along the conveyance path, a V-shaped diverter extending downwardly into the region of the nip, driving means coupled to the pulleys for driving the belts in unison at high speed, means coupled to the driving means for reciprocating the feed plates inwardly and outwardly from one another, the feed plates having vacuum ports coupled to a source of vacuum, valves operatively coupled to the drive means for connecting the vacuum ports of each of the plates simultaneously to the source of vacuum during inward movement for gripping the lowermost cards in the respective stacks for advancement thereof into engagement with the diverter and thence into the inlet nip, each feed plate presenting a shallow arcuate surface in the region of the vacuum ports so that when vacuum is applied the lowermost card is drawn downwardly from the stack and formed into arcuate cross section, and a stationary stripper member at the outlet of each of the hoppers for permitting passage of the lowermost card while holding back the remainder of the stack, the feed plates being in lateral alignment and the feed plates being driven with their inward movements in phase with one another so that the cards are delivered for insertion into a volume substantially in register with one another, a frictionally surfaced roller being recessed in each of the feed plates for presenting a frictional surface to the lowermost card, the roller having a one-way clutch so that the roller is non-rotating to apply a propelling force to the lowermost card during the inward stroke of the feed plate but rotates idly during the outward stroke.

3. The combination as claimed in claim 2 in which the roller has means for biasing the same upwardly with respect to the feed plate and in which the action of vacuum draws the lowermost card down against the roller compressing the biasing means and increasing the reaction pressure of the roller against the card.

4. A card inserter for inserting post cards in a series of volumes in a production line comprising, in combination, a frame having a substantially vertical feed plane, first and second upwardly facing feed plates on opposite sides thereof, first and second hoppers on the frame for holding respective stacks of cards superimposed upon the feed plates, a conveyor including a pair of flat endless belts arranged face-to-face having an inlet end and an outlet end and positioned along an angular conveyance path, the belts being trained about a pair of pulleys at the inlet end to define an inlet nip at the feed plane and a pair of pulleys at the outlet end as well as intermediate pulleys for maintaining the belts snugly face-to-face along the conveyance path, a V-shaped diverter extending downwardly into the region of the nip and centered on the feed plane, driving means coupled to the pulleys for driving the belts in unison at high speed, means coupled to the driving means for reciprocating the feed plates inwardly and outwardly from one another, the feed plates having unidirectional friction means so that the lowermost cards in the stacks are engaged during the inward movement for transport into engagement with the diverter and thence into the inlet nip in register with one another, a stationary stripper member at the outlet of each of the hoppers for permitting passage of the lowermost card therefrom while holding back the remainder of the stack, the V-shaped diverter having a central clearance space at the feed plane, and means including a phasing device for feeding a third card through the central clearance space for registered sandwiching between the first two cards so that three cards are delivered from the conveyor in register with one another for insertion into a volume.

5. A card inserter for inserting post cards in a series of bound volumes in a production line comprising, in combination, a frame having substantially vertical feed plane, first and second upwardly facing feed plates on opposite sides thereof, first and second hoppers on the frame for holding respective stacks of cards supported on the feed plates, a conveyor having a pair of pulleys at the inlet end to define an inlet nip at the feed plane, means for driving the conveyor, means coupled to the driving means for reciprocating the feed plates in unison inwardly and outwardly from one another, the feed plates having unidirectional friction means so that the lowermost cards in the stacks are engaged during the inward movement for transport into the inlet nip, a stationary stripper member at the outlet of each of the hoppers for permitting passage of the lowermost card therefrom while holding back the remainder of the stack, and means including a phasing device for feeding a third card downwardly along the feed plane for registered sandwiching between the first two cards at the nip so that three cards are delivered from the conveyor in register with one another for insertion into a volume.

6. A card inserter for inserting post cards in a series of volumes in motion in a production line comprising, in combination, a frame having a substantially vertical feed plane and upwardly facing feed plates on opposite sides thereof, a pair of hoppers on the frame for holding respective stacks of cards supported on the feed plates, a conveyor in the form of a pair of flat endless belts arranged face to face, the belts being trained about a pair of inlet pulleys to form an inlet nip at the feed plane below the level of the feed plates and being trained about a pair of outlet pulleys to form an outlet angularly related to the inlet nip to define an angular conveyance path, intermediate pulleys for maintaining the belts face-to-face along the conveyance path, driving means coupled to the pulleys for driving the belts in unison at high speed, means coupled to the driving means for reciprocating the feed plates inwardly and outwardly with respect to one another in unison, a frictionally surfaced roller recessed in each of the feed plates for movement therewith bearing against the lowermost card in the stack and having a one-way clutch so that the lowermost cards are frictionally propelled endwise during inward movement of the feed plates for advancement into the conveyor, the feed plates in addition having vacuum ports coupled to a source of vacuum, valves operatively coupled to the driving means for connecting the vacuum ports to the source of vacuum for gripping of the lowermost card and for pulling it down against the roller during the inward movement of the plates, each feed plate being recessed to form a shallow longitudinally extending channel in the region of the vacuum ports so that when vacuum is applied the lowermost card is drawn downwardly from the stack and formed into shallow arcuate cross section thereby longitudinally stiffening the same for endwise propulsion, and a stationary stripper member at the outlet of each of the hoppers for permitting passage of the lowermost card while holding back the remainder of the stack, the feed plates being in lateral alignment and the feed plates being driven with their inward movement in phase with one another so that the cards are delivered for insertion into a volume substantially in register with one another.

7. A card inserter for inserting post cards in a series of volumes in motion in a production line comprising, in combination, a frame having a substantially vertical feed plane and upwardly facing feed plates on opposite sides thereof, a pair of hoppers on the frame for holding respective stacks of cards supported on the feed plates, a conveyor in the form of a pair of flat endless belts arranged face-to-face, the belts being trained about a pair of inlet pulleys to define an inlet nip and a pair of outlet pulleys as well as intermediate pulleys for maintaining the belts face-to-face along an angular conveyance path, the upper surfaces of the feed plates being substantially tangential to the inlet pulleys, driving means coupled to the pulleys for driving the belts in unison at high speed, means for reciprocating the feed plates inwardly and outwardly with respect to one another, the feed plates being frictional rollers respectively recessed therein with the roller periphery being presented to the lowermost card in the stack, the roller having a one-way clutch to prevent rotation during inward movement for frictional gripping of the lowermost cards in the respective stacks for advancement thereof into the conveyor, a stationary stripper member at the outlet of each of the hoppers for permitting passage of the lowermost card while holding back the remainder of the stack, the frictional rollers having respective biasing springs for urging the same above the upper surfaces of the feed plates and means for pressing the lowermost cards against the respective frictional rollers, the feed plates being in lateral alignment and the feed plates being driven with their inward movements in phase with one another so that the cards are delivered for insertion into a volume substantially in register with one another.

8. A card inserter for inserting post cards in a series of volumes in motion in a production line comprising, in combination, a frame having a substantially vertical feed plane and a pair of feed plates on respectively opposite sides thereof, the feed plates having upwardly facing supporting surfaces and being mounted for reciprocating movement inwardly and outwardly, a pair of hoppers on the frame for holding respective stacks of cards supported on the feed plates, a conveyor in the form of a pair of flat endless belts arranged face-to-face providing an inlet and an outlet, the belts being trained about a pair of inlet pulleys to form an inlet nip for driving the cards, the inlet nip being substantially aligned with the feed plane and at a level below the feed plates, means for driving the belts in unison at high speed, means coupled to the driving means for reciprocating the feed plates in phase with one another, means on the feed plates for gripping the lowermost card in each stack for transport from the hopper during inward movement and for releasing the card during outward movement, each of the inlet pulleys having an idler roller vertically opposed thereto, the idler rollers defining, with the associated belt, auxiliary driving nips substantially aligned with the supporting surfaces of the respective feed plates and closely adjacent the inlet nip, the hoppers being arranged closely adjacent the auxiliary driving nips so that only limited inward movement of the feed plates suffices to insure engagement of the leading edges of the lowermost cards in the auxiliary driving nips, the hoppers being in lateral alignment so that the cards transported by the feed plates are received at the inlet nip and are discharged at the outlet substantially in register with one another.

9. The combination as claimed in claim 8 in which the feed plates are narrower than the cards to define laterally extending card edges and in which the pulleys, conveyor belts and idler rollers are each formed in two axially spaced sections with the inlet pulley sections and cooperating idler roller sections straddling the feed plate for movement of the feed plate therebetween for feeding of the card edges to the auxiliary driving nips.

10. A card inserter for inserting post cards in a series of bound volumes in a production line comprising, in combination, a frame having a substantially vertical feed plane, first and second upwardly facing feed plates on opposite sides thereof, first and second hoppers on the frame for holding respective stacks of cards supported on the feed plates and having respective outlets, a conveyor having a pair of pulleys at an inlet end to define an inlet nip at the feed plane, means for driving the conveyor, means coupled to the driving means for reciprocating the feed plates in unison inwardly and outwardly from one another, the feed plates having unidirectional friction means so that the lowermost cards in each of the stacks are engaged during the inward movement, a stationary stripper member at the outlet of each of the hoppers for permitting passage of the lowermost cards therefrom while holding back the remainder of the stack so that two cards are transported into the inlet nip in registering relation, a third upwardly facing feed plate having unidirectional friction means and located on the frame above the level of the first and second hoppers, a third hopper associated therewith having a stationary stripper member, means coupled to the driving means for reciprocating the third feed plate for delivery of a third card, a phase advancing means being interposed between the driving means and the third feed plate so that the third card is sandwiched between the first two cards at the nip so that a total of three cards are delivered from the conveyor in register with one another for insertion into a volume.

* * * * *